US005103972A

United States Patent [19]

Ackeret

[11] Patent Number: 5,103,972

[45] Date of Patent: Apr. 14, 1992

[54] CONTAINER FOR PICTURE-FRAME-LIKE PHOTOGRAPHIC PRINT HOLDER

[75] Inventor: Peter Ackeret, Kusnacht, Switzerland

[73] Assignee: Licinvest AG, Chur, Switzerland

[21] Appl. No.: 620,618

[22] Filed: Dec. 3, 1990

Related U.S. Application Data

[63] Continuation-in-part of Ser. No. 444,136, Nov. 30, 1989, abandoned.

[30] Foreign Application Priority Data

Apr. 12, 1988 [DE] Fed. Rep. of Germany ..... 3812062
Apr. 7, 1989 [WO] PCT Int'l Appl. PCT/EP89/00370

[51] Int. Cl.[5] ..... B65D 5/02

[52] U.S. Cl. ..... 206/232; 206/449; 206/455; 229/10; 229/120.08

[58] Field of Search ..... 206/387, 444, 232, 45.14, 206/424, 449, 454–456; 229/9, 10, 19, 120.08, 120.17, 120.18, 120.19, 120.21, 120.29

[56] References Cited

U.S. PATENT DOCUMENTS

| | | | |
|---|---|---|---|
| 1,769,596 | 7/1930 | Neidich | 206/215 |
| 2,196,482 | 4/1940 | Taylor . | |
| 2,335,107 | 11/1943 | Ciringione . | |
| 2,478,635 | 8/1949 | Overly . | |
| 2,502,214 | 3/1950 | Gianninoto . | |
| 2,617,699 | 11/1952 | Sullivan . | |
| 2,622,897 | 12/1952 | Zenick | 206/424 X |
| 2,799,441 | 7/1957 | Nerney . | |
| 3,412,244 | 11/1968 | Sherwood . | |
| 3,682,297 | 8/1972 | Austin et al. | 206/45.14 |
| 3,710,977 | 1/1973 | Van den Enden et al. | 221/102 |
| 4,093,069 | 6/1978 | Smolderen | 206/455 |
| 4,134,495 | 1/1979 | Friedman | 206/387 |
| 4,445,634 | 5/1984 | Sato | 229/40 |
| 4,674,632 | 6/1987 | Friedman | 206/232 |
| 5,007,537 | 4/1991 | Ackeret | 206/455 |

FOREIGN PATENT DOCUMENTS

| | | | |
|---|---|---|---|
| 293217 | 7/1916 | Fed. Rep. of Germany | 206/455 |
| 59-223981 | 12/1984 | Japan . | |
| 425645 | 10/1982 | Sweden . | |

*Primary Examiner*—Bryon P. Gehman
*Attorney, Agent, or Firm*—Robert R. Jackson

[57] ABSTRACT

A sleeve for a photo print cassette and associated negatives includes a partition wall to define a first compartment for the cassette and a second compartment for the negatives. The partition wall may be integrally formed with the sleeve walls in one single blank, or it may be a portion of a separate pocket member removable from the sleeve to get access to the pocket contents.

25 Claims, 10 Drawing Sheets

CONTAINER FOR PICTURE-FRAME-LIKE PHOTOGRAPHIC PRINT HOLDER

This is a continuation-in-part of application Ser. No. 07/444,136, filed Nov. 30, 1989, now abandoned.

The present invention relates to a sleeve for a sheet cassette. Such a sleeve is subject of International Patent Application WO 88/00721. The sleeve of this prior art serves to accommodate so-called sheet exchangers; a sheet exchanger is an apparatus which permits cyclic rearrangement of e.g. photographic prints. For practical reasons, in particular archiving, it is desirable to store such prints together with the photographic negatives from which the prints are drawn. For this reason, the prior art sleeve has a double-walled large side, the interior of this side being accessible via a slot so that a bag holding negatives may be inserted.

Upon insertion of the negatives in the pocket so formed, the double-wall forming parts are spread apart, and in order to prevent bulging of the entire sleeve, its width is to be dimensioned to accommodate such spreading. If, however, the negatives are not stored in the sleeve for any reason, the cassette is only loosely received between the sleeve walls which evidently is undesirable.

It is the object of the present invention to provide a sleeve without this drawback.

Several aspects of the present invention are defined in the independent claims. In principle, the formation of the pocket does not involve, as in the prior art, an elastic deformation of the sleeve itself but provides sufficiently dimensioned compartments for the cassette and for supplementary material, i.e. in particular for a bag holding photographic negatives. The two compartments are separated by a partition wall so that the contents of either one is safely stored even if the other one is empty.

Embodiments of the invention are illustrated in the accompanying drawings and will be explained in detail hereunder.

Figures 1, 2:
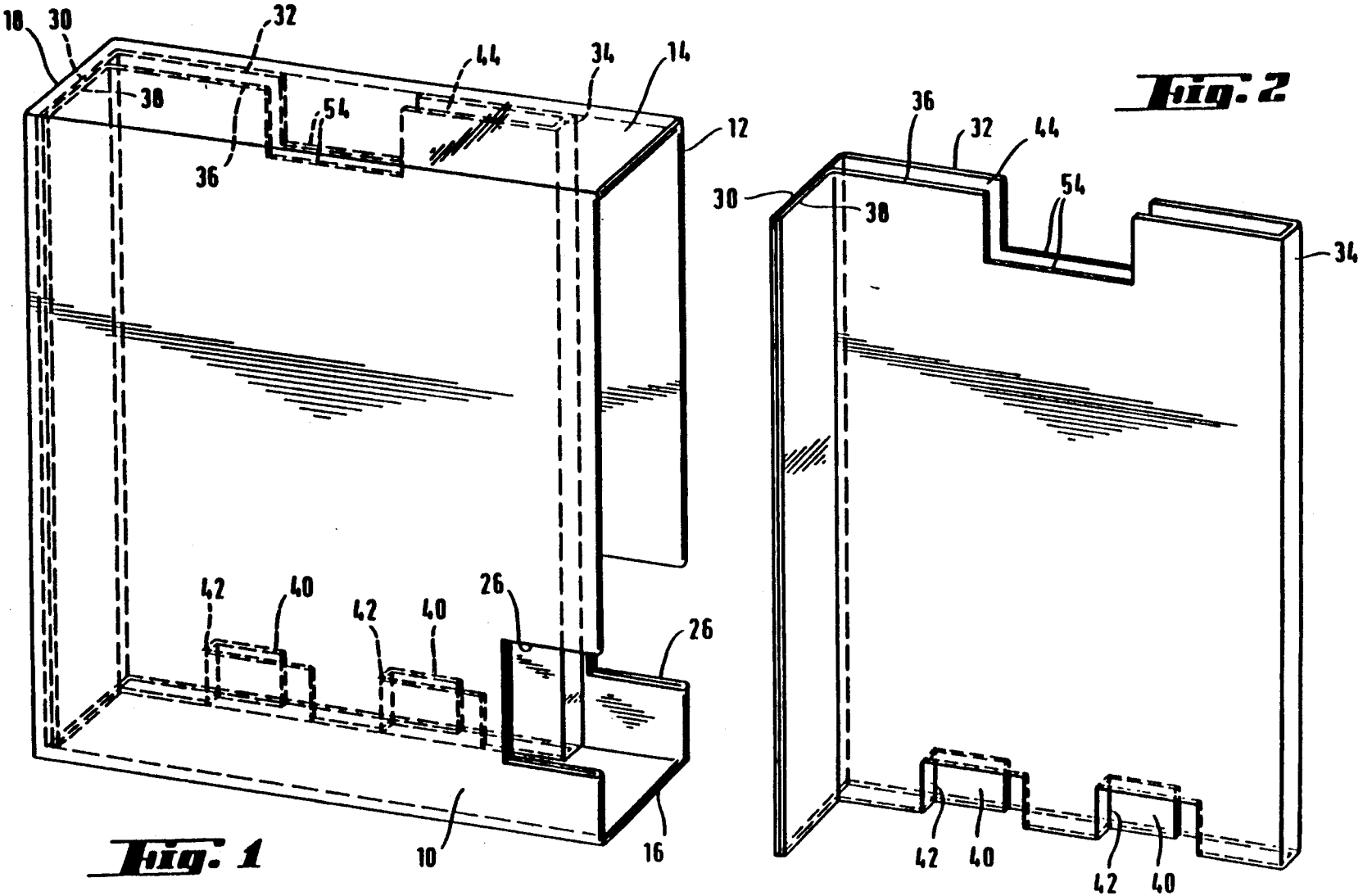
FIG. 1 is an isometric view of a two-part sleeve according to the invention.
FIG. 2 shows the pocket member of FIG. 1.

Referring first to FIGS. 1 through 4, the sleeve is comprised of a sleeve member and a pocket member which may be removed from the sleeve member. The sleeve member has basically an epipedic shape including two parallel large side walls 10 and 12, a top wall 14, a bottom wall 16, and a rear wall 18 opposite an open front. Side walls 10, 12 have finger access recesses 26 so that an inserted sheet cassette 20 (FIG. 4) may be grasped and withdrawn. In this first embodiment, the sleeve member is made of a transparent plastic material but opaquely coated except display window 22 in one of its side walls and display window 24 in rear wall 18. Alternatively, the sleeve member may be mae of opaque material, e.g. cardboard; the display windows 22, 24 will then simply be cut out.

The pocket member is inserted, together with a sheet cassette if desired, into the empty sleeve member. The pocket member has a height commensurate with the inner height of the sleeve member, and it extends from the inner side of the rear wall parallel to and in abutting relation with side wall 12 short of the recess 26 of the latter.

Figure 3:
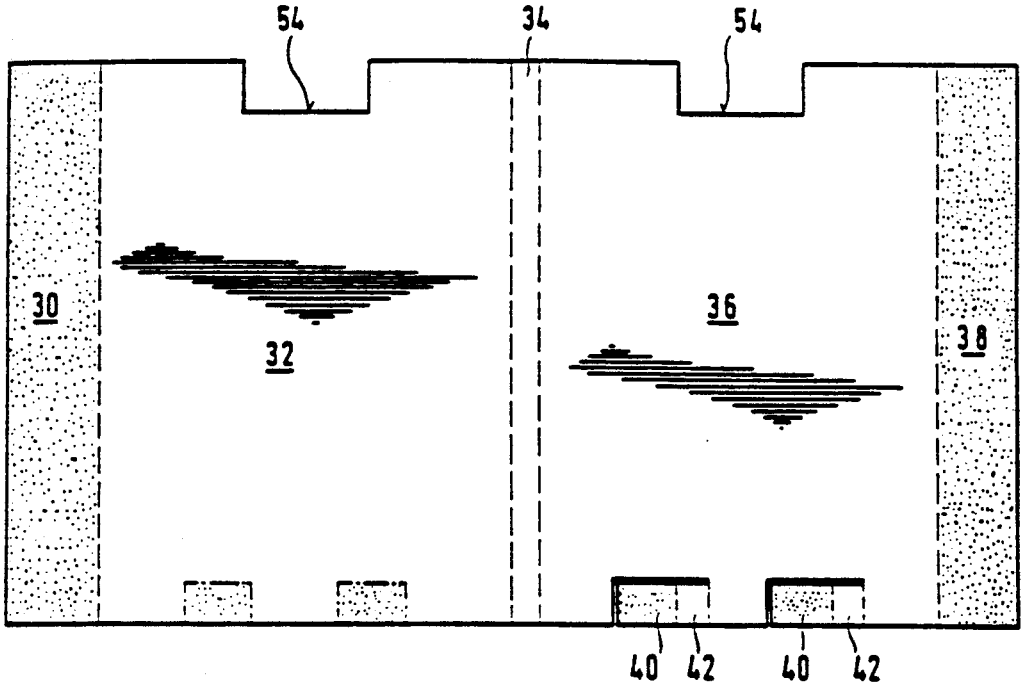
FIG. 3 shows the blank for the pocket member of FIG. 2.

In the blank illustrations, solid lines are cut lines while dashed lines are folding lines, and so in FIG. 3. The blank comprises an extension field 30, a first pocket field 32, a strap field 34, a second pocket field 36, and a glue field 38. The second pocket field exhibits two L-shaped cuts defining flaps 40 which, in turn, are folded to assume L-shape. FIG. 2 illustrates how these fields and flaps are folded and glued to form the pocket member. It will be recognized that by re-bending of the extension and glue fields into the plane of the pocket fields the pocket member may be made to collapse and to assume a flat configuration; this permits to save storage space and easy labelling. Once inserted into the sleeve member, however, the pocket member cannot collapse any more or be compressed upon insertion of a sheet cassette because it is supported at three of its edges. The transverse portions 42 of flaps 40 prevent falling-off of material received in the pocket, e.g. photographic negatives, on the side of the pocket opposite an access opening. The flaps, nevertheless, do not interfere with the collapsability of the pocket member.

It will be understood that the flaps 40 may be cut from field 32 instead field 36.

Pocket field 32 which is in abutting relation with side wall 12 has a label area congruent with display window 22, and similarly there is a label area in alignment with window 24.

It will be understood that the pocket member must be withdrawn from the sleeve member in order to get access to contents of the pocket. This is not necessary if the pocket is accessible from the open front of the sleeve. In this case, however, there is no need to provide the sleeve in the two-part design. Such a modified embodiment is illustrated in FIGS. 5 through 7.

Figure 4:
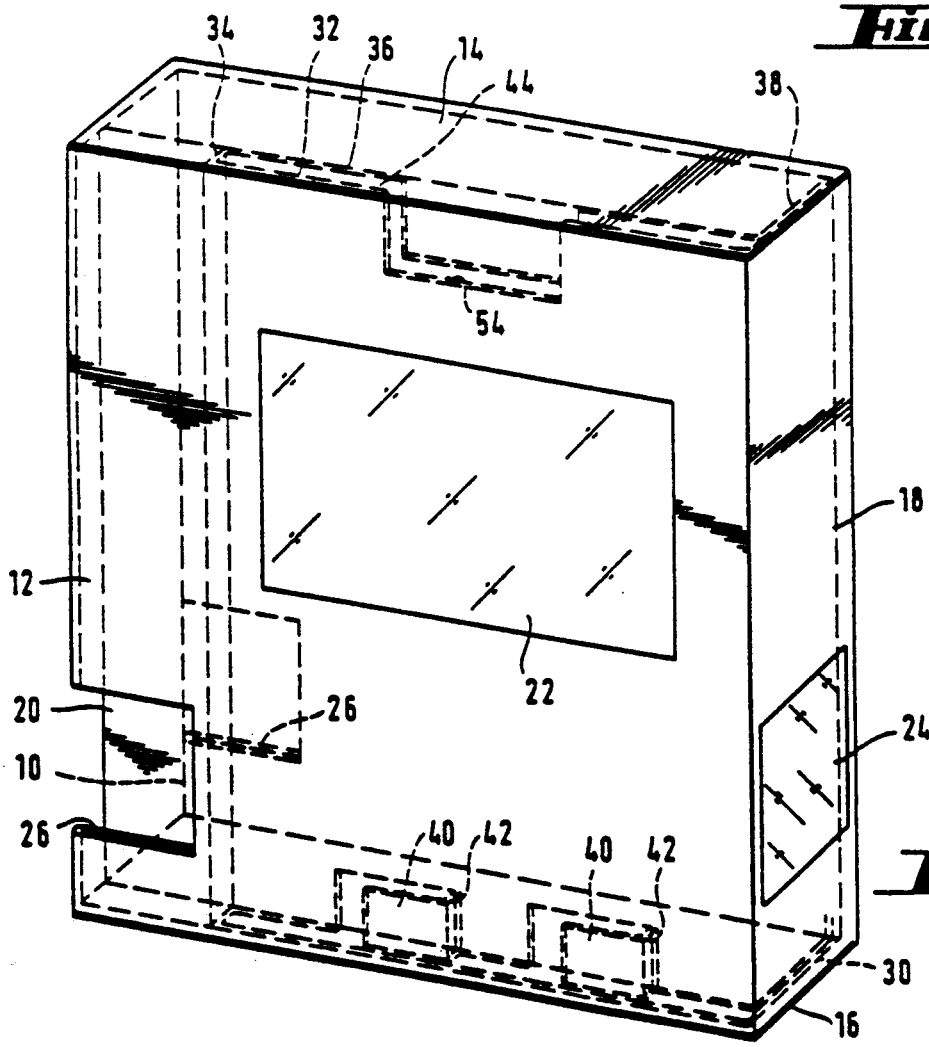
FIG. 4 is an isometric view of the sleeve of FIG. 1 under another angle.
Figure 5:
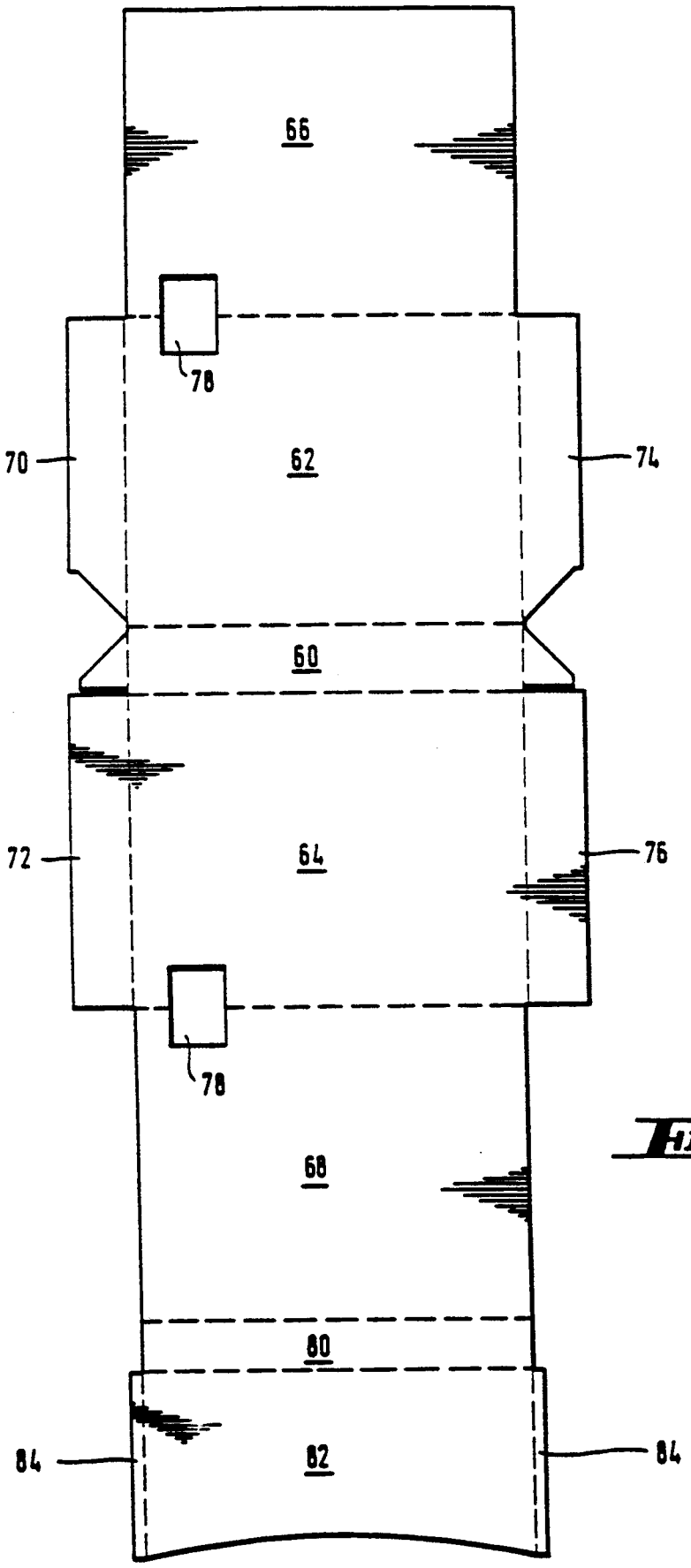
FIG. 5 shows the blank of a one-part sleeve according to the invention.

The blank shown in FIG. 5 preferably is made of cardboard, decoratively laminated if desired. It comprises, starting from a rear wall field 60, outer side wall fields 62 and 64, followed by inner side wall fields 66 and 68, respectively. Top wall fields 70 and 72 are respectively connected to fields 62 and 64 via folding lines (dashed), and bottom wall fields 74 and 76 are similarly provided. Recesses similar to recesses 26 in FIGS. 1 and 4 are provided by cutouts 78 upon folding field 66 unto field 62 and field 68 unto field 64.

The end of field 68 opposite field 64 is connected, via a folding line, to a first spacing field 80 which as narrower than rear wall face 60 by the thickness of the to-be-formed pocket. The first spacer field, in turn, is connected via a folding line to a pocket field 82 which is connected via folding lines to second spacing fields or strap fields 84. These second spacing fields have a width about equal to that of the to-be-formed pocket.

Figure 6:
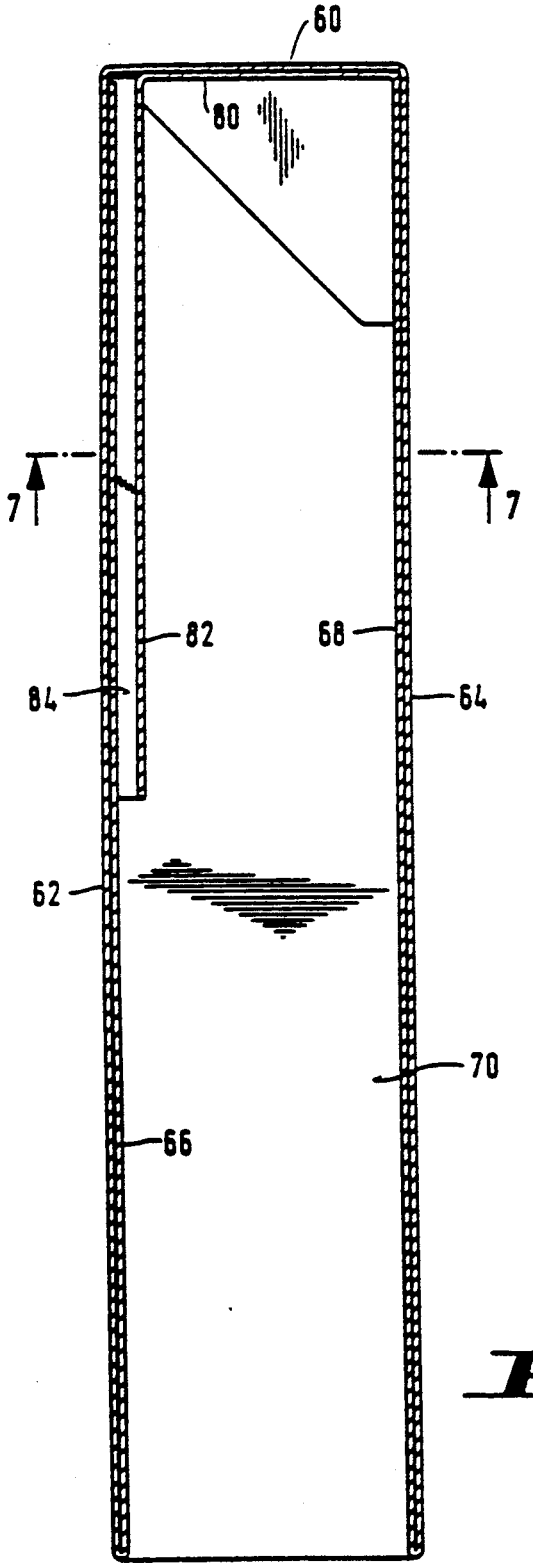
FIG. 6 is a section view parallel to the top wall of the sleeve erected and glued from the blank of FIG. 5.
Figure 7:
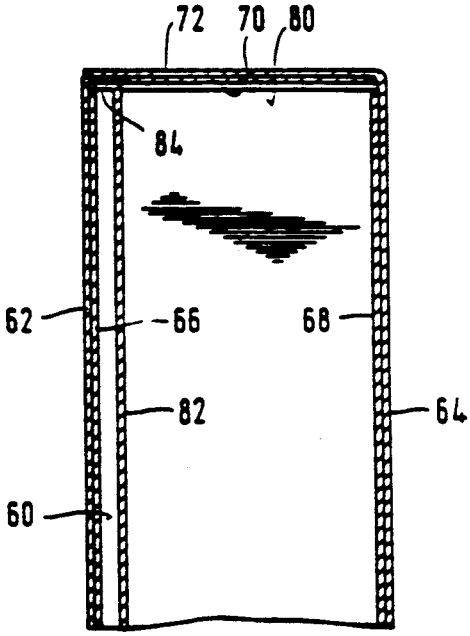
FIG. 7 is a partial section view along line 7—7 in FIG. 6.

FIGS. 6 and 7 illustrate how the sleeve is erected. The end of the pocket field adjacent the rear wall is positioned along its entire length by first spacing field 80, and the end edges of the pocket field extending along top and bottom wall find support on field 62 by means of second spacing fields 84, the free ends of fields 84 being snap-engaged behind free edges of field 66; it is to be noted that the respective undersize amounts are not recognizable in FIG. 5 because of the small scale of this drawing while FIGS. 6 and 7 are about natural size of the sleeve. It will be understood that respectively abutting fields are glued together at suitable points. Similarly, is common practice to fold-in the triangular end flaps of rear wall field 60.

Figure 8:
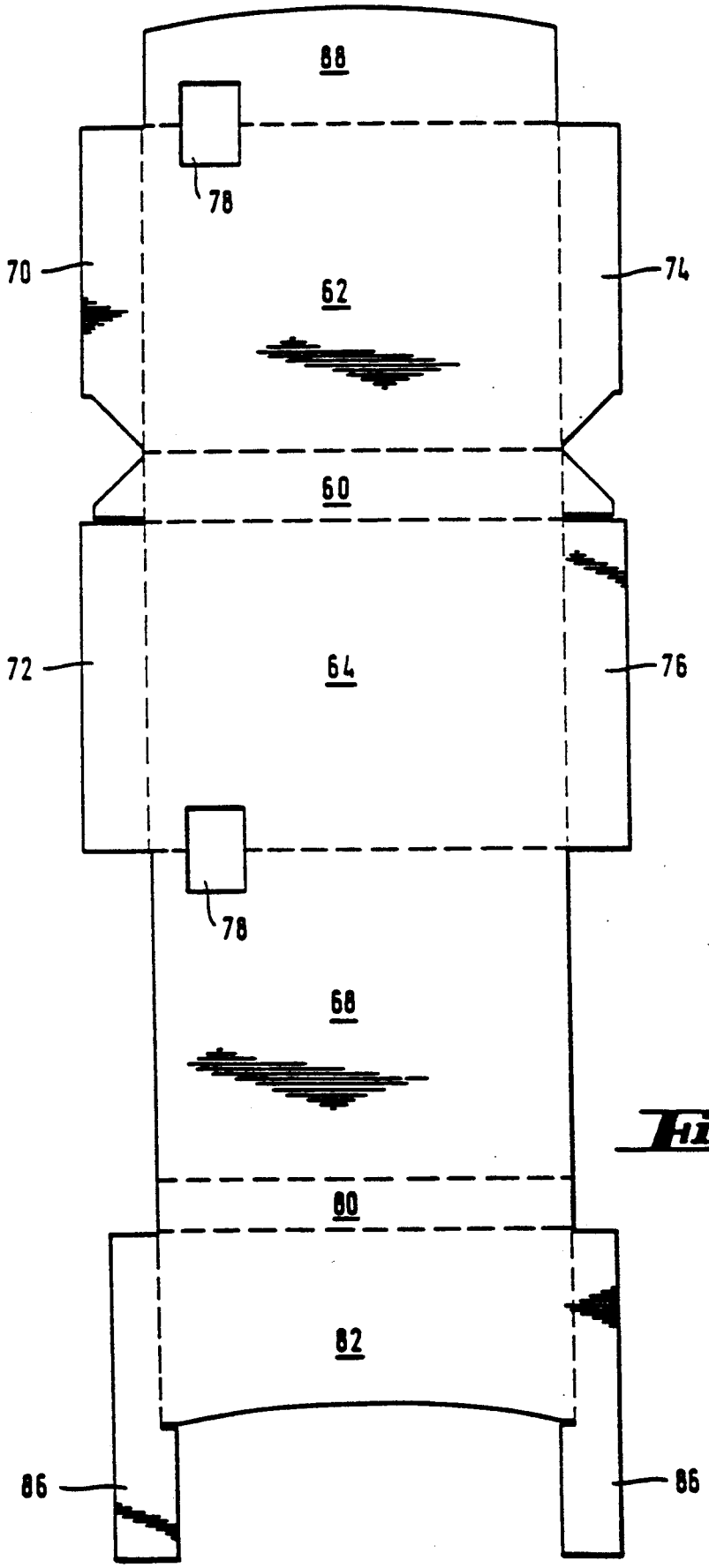
FIGS. 8 through 10 show in a manner analog to FIGS. 5 through 7 a modified form of the sleeve.
Figure 9:
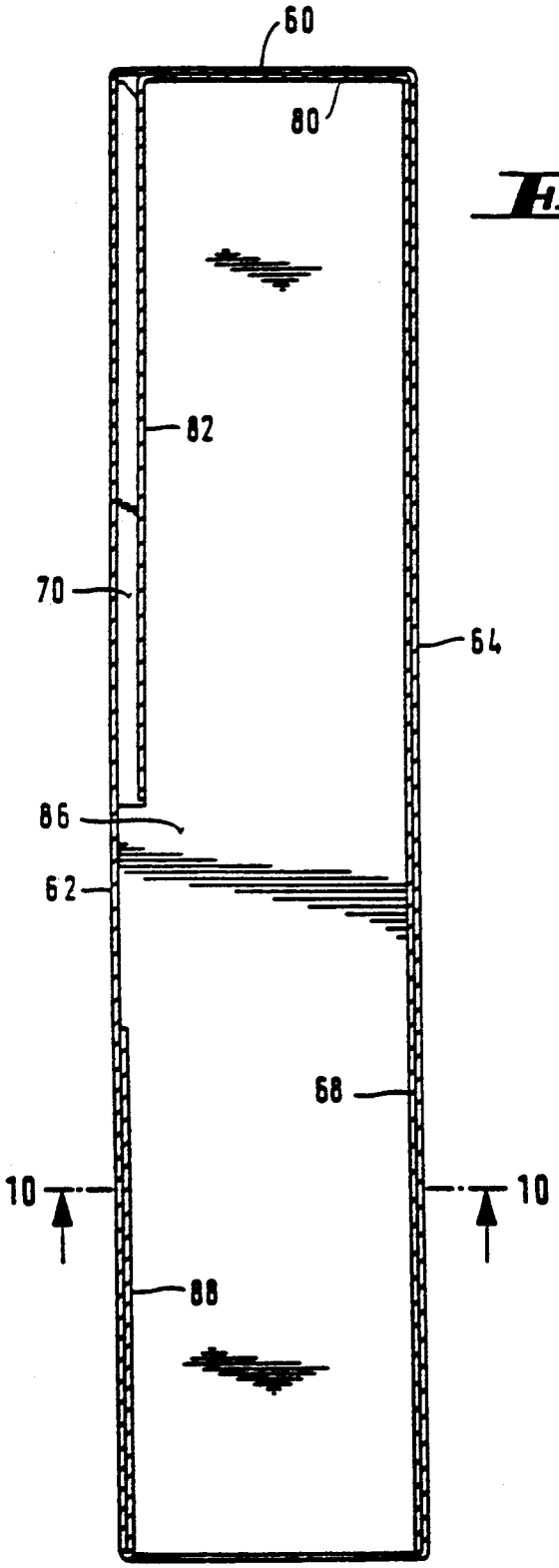
Figure 10:
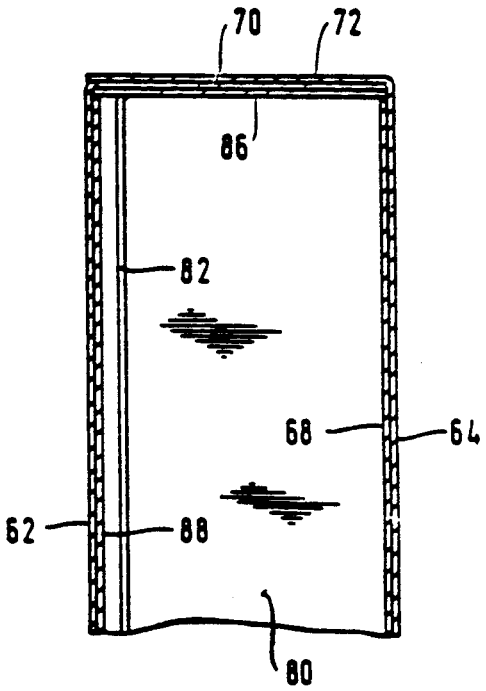

FIGS. 8 through 10 illustrate a modification of the sleeve just described. Field 66 is replaced by a shorter field 88, and the strap or second spacing fields 84 are replaced by support fields 86 which, of course, play a similar role. These fields 86 are folded, upon erection of the sleeve, about 90° but in a direction opposite that of the preceding embodiment so that the configuration illustrated in FIG. 9 and 10 will result. The snap-fit of fields 86 occurs at both of their edges as may be seen in FIG. 10. As far as the consideration of the cardboard thickness for this snap-fit is concerned, the remark made in connection with FIG. 5 will apply here too.

Figure 11:
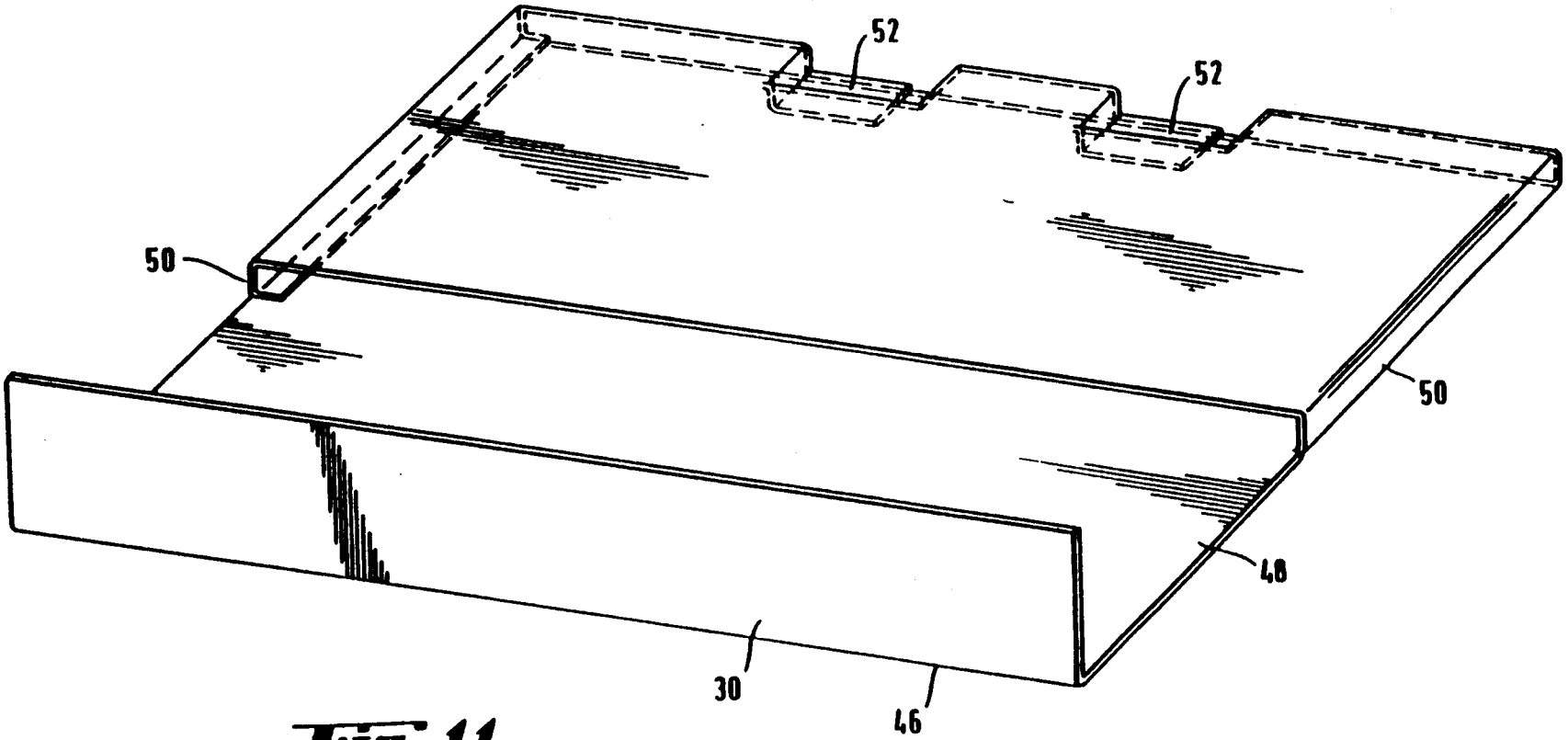
FIG. 11 is an isometric view of a pocket member for the sleeve shown in FIGS. 1 and 4.

FIG. 11 illustrates a modification of the pocket member of FIG. 2. The access opening of the pocket extends, as in FIGS. 5 through 7 or FIGS. 8 through 10, parallel to the sleeve member open front, but faces away from the latter so that again the pocket member must be withdrawn to get access to its contents. The pocket opening, in fact, extends parallel to extension 30 which is joined to a larger pocket field 48 via folding line 46. Spacing strips 50 extend transverse to the opening adjacent top and bottom walls of the sleeve member. The pocket member end remote from the opening and adjacent open sleeve member front is blocked by L-shaped flaps 52 which are cut, folded, and glued as shown so that contents of the pocket member, as a bag full of negatives, may not fall off. In this modified configuration, the pocket member may also be collapsed for storing and labeling purposes.

The depth of the pocket is such that the usual negative bags project beyond the pocket access opening so to facilitate removal. In the form of FIG. 2, however, the bag must completely be received in the pocket which necessitates recesses 54 which facilitate removal.

Figure 12:
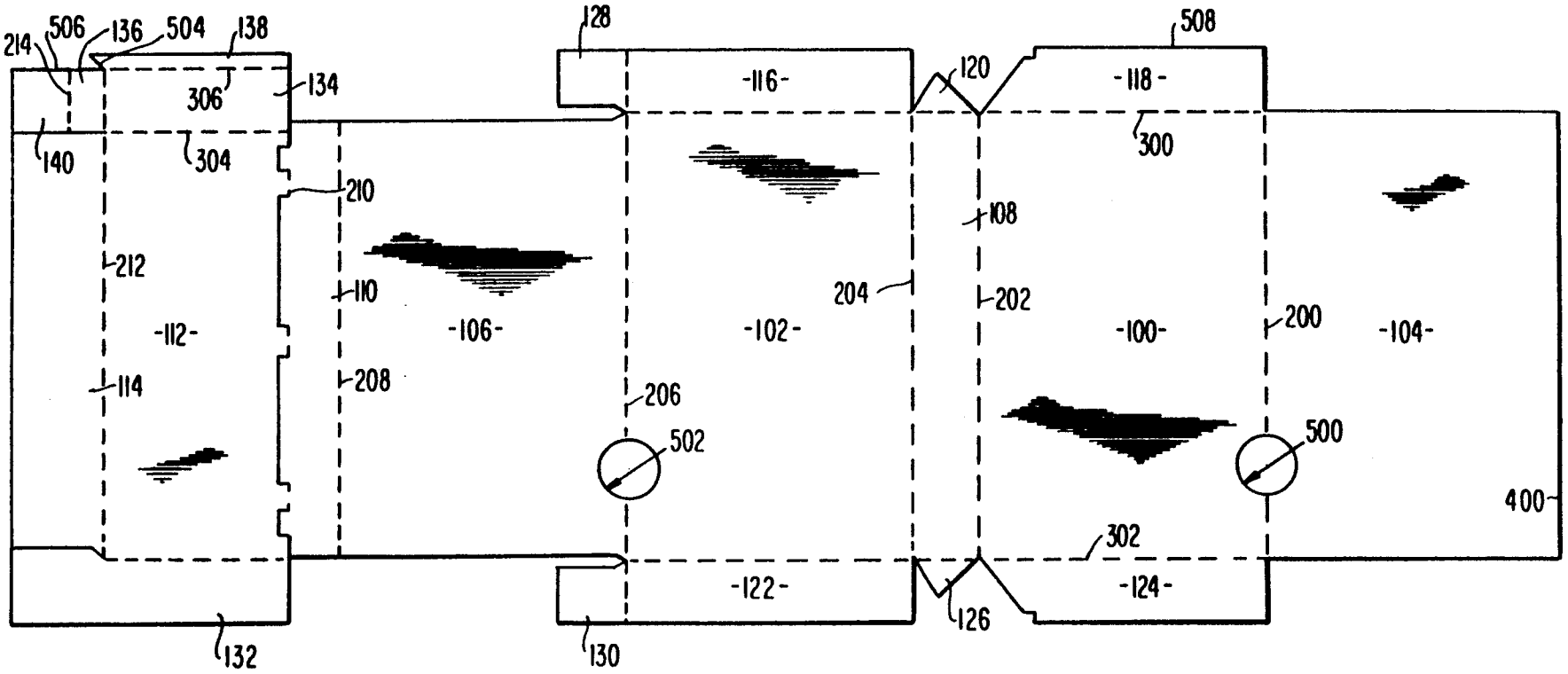
FIG. 12 illustrates the blank of a further embodiment of the invention.
Figure 13:
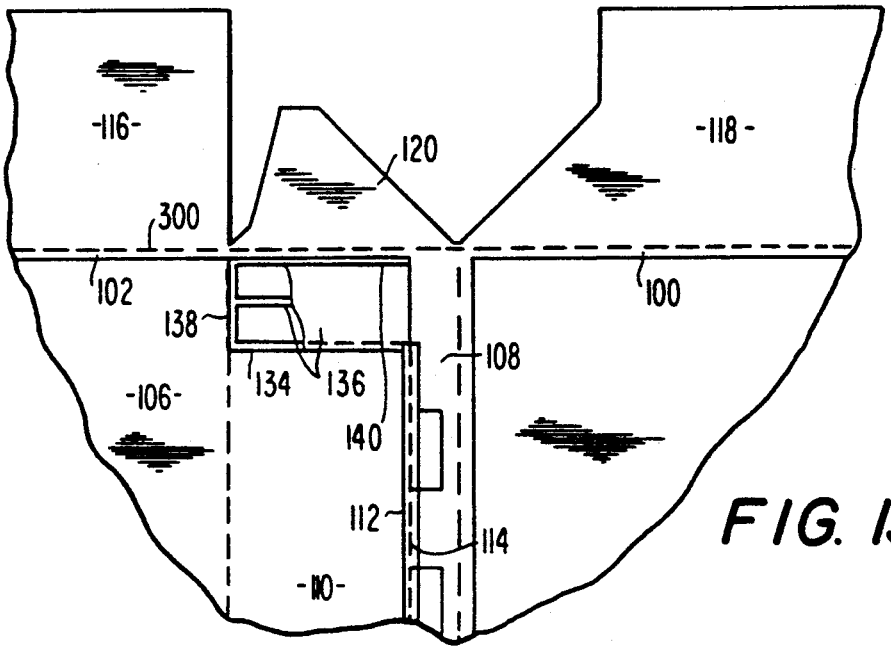
FIG. 13 is a partial plan view of the partly erected sleeve made from the blank of FIG. 12.
Figure 14:
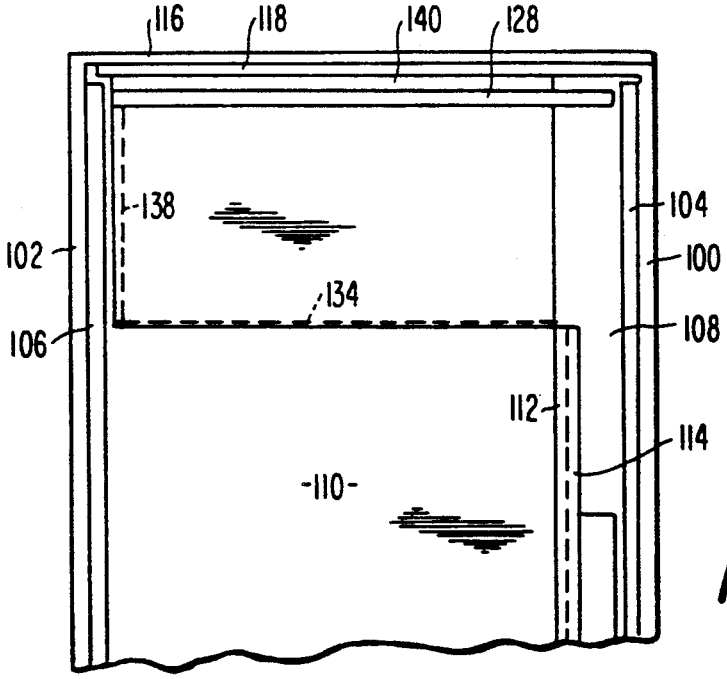
FIG. 14 is a partial section view of the sleeve made from the blank of FIG. 12.
Figure 15:
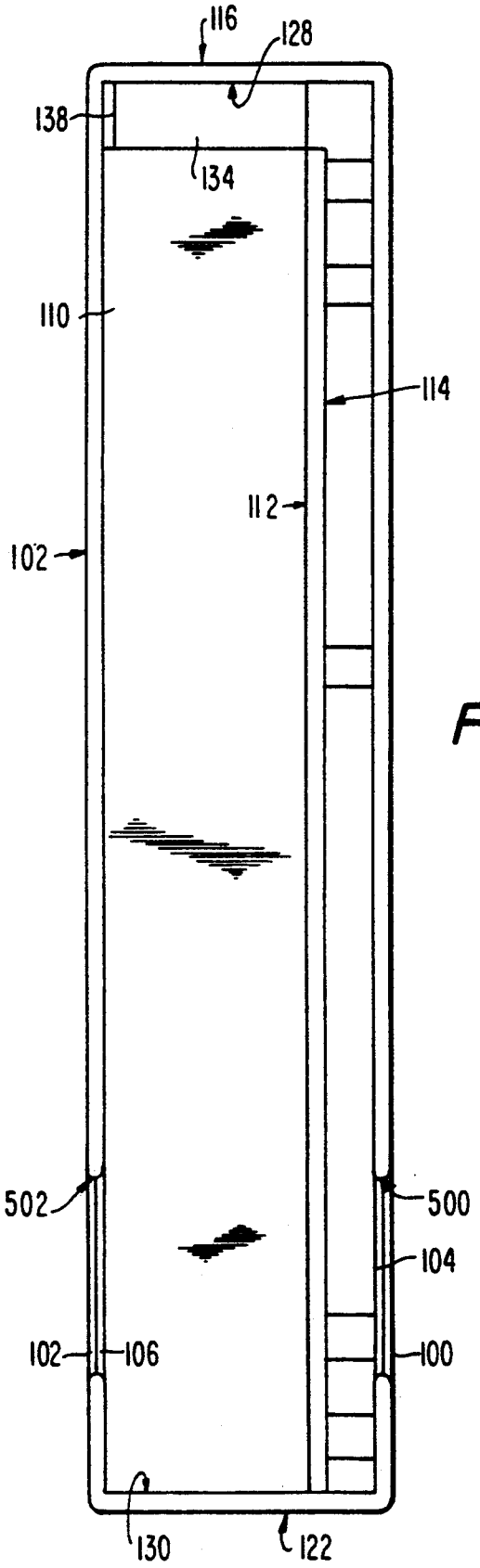
FIG. 15 is an elevational view of the open side of the sleeve made from the blank of FIG. 12.

FIGS. 12 to 14 illustrate a further embodiment of the sleeve according to the invention. This embodiment exhibits the particularity that the height of the pocket between top wall and bottom wall exceeds the respective height of the cassette compartment.

FIG. 12 shows the blank, solid lines indicating cut lines and dashed lines marking holding lines.

The blank comprises
a first outer side wall portion 100,
a second outer side wall portion 102,
a first lining side wall portion 104,
a second lining side wall portion 106,
an outer rear wall portion 108,
an inner rear wall portion 110,
a main partition wall portion 112,
a partition wall lining portion 114,
an outer top wall portion 116,
an inner top wall portion 118,
a top wall flap portion 120,
an outer bottom wall portion 122,
an inner bottom wall portion 124,
a bottom wall flap 126,
a top securing flap 128,
a bottom securing flap 130,
a bottom cover portion 132,
a top spacing portion 134,
a top ramp portion 136,
a ramp support portion 138,
a top mount portion 140.

In the drawing, margins to cope for the thickness of the cardboard have been omitted for sake of simplicity.

Folding lines 200, 202, 204, 206, 208, 210, 212, 214 all extend parallel to one another and parallel to the free end edge 400 of portion 104. Folding lines 300, 302, 304, 306 all extend parallel to oneanother and perpendicularly with respect to the 200'th folding lines. It is to be noted that folding line 210 comprises five separate "hinges" whose axes are coextensive so as to define a "virtual" folding line.

Upon the erection of the blank as herinafter explained, "folding" means that the respective portion is folded about 180°, and "bending" means that it is bent about 90°. In the following description, the individual portions are designated by their reference numerals only in an attempt to simplify and shorten the text. 104 is folded about line 200 upon 100 and glued thereto so as to form a lined large side wall. The recess 500 thereafter presents a semi-circular finger recess contour. 114 is folded about 212 upon 112 and glued thereto thereby forming a partition wall. 106 is folded about 206 upon 102 and glued thereto so as to form a second lined large side wall presenting a finger recess 502.

The large side walls 100/104, 102/106 and the partition wall 112/114 are bent about lines 202, 204 and 210, respectively, so as to extend all in the same direction, and 110 is glued unto 108. 134 is bent about 304 so as to extend toward 106, and 138 is bent about 306 in opposite direction. It is to be noted that 304 is offset with respect to 300 by the width of 138 so that 134 extends along 204 to terminate at 300. 136 is angled about 45° and 140 is angled also about 45° in opposite direction so that 136 is supported by the edge 504 of 138.

This phase of the erection is in part illustrated in FIG. 13 which is a section view through 136, the side walls being illustrated unbent for sake of clarity.

132 is bent about 302, 124 and 126 are bent about 302, and 132 is glued to 124 and 126. 118 and 120 are bent about 300, and 140 is glued to 118 such that edges 506 and 508 are flush. 122 is bent about 302 and glued to 124 and 126. 116 is bent about 300 and glued to 118 and 120. Finally, 128 and 130 are folded inwards about 206 and glued to 132 and 140, respectively.

FIG. 14 is a partial section through 140, hatching being omitted for sake of clarity. It will be seen that the cassette accommodating cavity is delimited by portions 106, 134, and 112 while the pocket is delimited by portions 114, 128, and 104. Portion 136 forms a ramp for introduction of a cassette.

It will be noted that the partition wall 112/114 extends from the rear wall 108/110 over a part only of the full depth of the sleeve. Partition wall 112/114 is secured properly spaced from the large side walls 100/104 and 102/106 by hinges 210 adjacent the rear wall, by portion 132 glued to 124, and by portion 134 which is glue-connected, via portion 140, to 118. Flap 128 is dimensioned to terminate just flush with folding line 214 while flap 130 terminates at folding line 212.

I claim:

1. A sleeve for a sheet cassette, comprising:

two parallel large side walls, a narrow top wall and a bottom wall parallel to and congruent with said top wall, a rear wall opposite an open front, said walls defining a substantially parallelepipedic cavity, said sleeve including a pocket field, said pocket field extending parallel to said large side walls and separating a cassette compartment from a compartment for accommodation of flat material, said rear wall having an outer wall portion and an inner wall portion, said inner wall portion being connected via a first folding line to said pocket field, said first folding line extending orthogonal to said top and bottom walls and being spaced from said large side walls by predetermined distances, said pocket field further comprising spacing elements forming part of said sleeve for maintaining a free end edge of said pocket field opposite said folding line spaced from said side walls by said predetermined distances so as to define a position in which said pocket field is fixed parallel to said large side walls even when said sleeve is empty.

2. The sleeve of claim 1 wherein said pocket field separates said cavity into a relatively wide cassette compartment and a relatively narrow flat material compartment.

3. The sleeve of claim 1 wherein said first folding line is defined by a plurality of dash-shaped spaced folding line sections.

4. The sleeve of claim 3 wherein said inner rear wall portion extends across a sleeve width between said large side walls where said first folding line sections are spaced.

5. The sleeve of claim 1 wherein said spacing elements are provided between said pocket field and each one of said large side walls.

6. The sleeve of claim 1 wherein at least one spacing element from said rear wall to said pocket field end edge.

7. The sleeve of claim 1 wherein spacing elements are provided adjacent a top end and adjacent a bottom end of said pocket field.

8. The sleeve of claim 1 wherein at least one of said spacing elements extends parallel to said top and bottom walls.

9. The sleeve of claim 8 wherein said at least one spacer element is glued to one of said top and bottom walls.

10. The sleeve of claim 1 wherein at least one of said spacing elements extends from said pocket field to an adjacent one of said large side walls.

11. The sleeve of claim 1 wherein said spacing elements are connected to said pocket field via second folding lines.

12. The sleeve of claim 1 wherein at least one spacing element extends to said open front.

13. The sleeve of claim 1 wherein at least one spacing element extends between said rear wall and said pocket field end edge.

14. The sleeve of claim 1 wherein said pocket field end edge is spaced from said open front towards said rear wall.

15. The sleeve of claim 14 wherein said large side walls have front-defining edges opposite said rear wall, and a finger-grip recess in at least one of said front-defining edges.

16. The sleeve of claim 15 wherein said recess has an inner end spaced from said open front by a distance less than a distance by which said pocket field end edge is spaced from said open front.

17. The sleeve of claim 1 erected from one single cardboard blank.

18. The sleeve of claim 17 wherein said blank includes:

an inner rear wall field, said pocket field connected to said inner rear wall field via said first folding line, spacer element fields connected to said pocket field via second folding lines, a first inner side wall field connected to said inner rear wall field via a third folding line parallel to said first folding line, a first outer side wall field connected to said first inner side wall field via a fourth folding line parallel to said third folding line, an outer rear wall field connected to said first outer side wall field via a fifth holding line parallel to said fourth folding line, a second outer side wall field connected to said outer rear wall field via a sixth folding line parallel to said fifth folding line, a second inner side wall field connected to said second outer side wall field via a seventh folding line parallel to said sixth folding line, an inner top wall field connected to said second outer side wall field via an eighth folding line, an inner bottom wall field connected to said second outer side wall field via a ninth folding line, an outer top wall field connected to said first outer side wall field via a tenth folding line, an outer bottom wall field connected to said first outer side wall field via a eleventh folding line, said second, eighth, ninth, tenth, and eleventh folding lines extending orthogonal with respect to said first folding line.

19. The sleeve of claim 18 wherein a first one of said second folding lines is coextensive with said eighth and tenth folding lines, and wherein a second one of said second folding lines is coextensive with said ninth and eleventh folding lines.

20. The sleeve of claim 18 wherein said spacer element fields have a width commensurate with the width of said compartment for accommodation of flat material.

21. The sleeve of claim 18 wherein at least one of said spacer element fields includes a first portion of a width commensurate with the width of said cassette compartment and a second portion of a width which substantially equals the distance between said large side walls.

22. The sleeve of claim 18 wherein said pocket field comprises a first pocket field portion connected to said inner rear wall portion and a second pocket field portion connected to said first pocket field portion via a twelfth folding line extending parallel to said first folding line.

23. The sleeve of claim 18 wherein upon erection of said blank, spacing element fields are snap-fitted between inner side wall fields and inner top and bottom wall fields.

24. The sleeve of claim 1 wherein said compartments extend over the entire distance between said top and bottom walls.

25. The sleeve of claim 1 wherein said pocket field end edge has a rounded contour.

* * * * *